US005140563A

United States Patent [19]

Thinesen

[11] Patent Number: 5,140,563

[45] Date of Patent: Aug. 18, 1992

[54] MULTIMODE ELECTRONIC TIMEPIECE HAVING A MUTUALLY EXCLUSIVE SUBMODE DISPLAY

[75] Inventor: Tom Thinesen, Sunnyvale, Calif.

[73] Assignee: Timex Corporation, Waterbury, Conn.

[21] Appl. No.: 802,582

[22] Filed: Dec. 5, 1991

[51] Int. Cl.[5] ..... G04C 17/00; G04C 19/00

[52] U.S. Cl. ..... 368/70; 368/82; 368/187

[58] Field of Search ..... 368/69-70, 368/82, 107-113, 185-188, 239, 319-321

[56] References Cited

U.S. PATENT DOCUMENTS

| | | | |
|---|---|---|---|
| 4,283,784 | 8/1981 | Horan | 368/87 |
| 4,354,260 | 10/1982 | Planzo | 368/10 |
| 4,398,834 | 8/1983 | Nakai | 368/223 |
| 4,780,864 | 10/1988 | Houlihan | 368/10 |
| 4,783,773 | 11/1988 | Houlihan et al. | 368/108 |
| 4,887,249 | 12/1989 | Thinesen | 368/10 |
| 5,050,141 | 9/1991 | Thinesen | 368/10 |

*Primary Examiner*—Vit W. Miska
*Attorney, Agent, or Firm*—William C. Crutcher

[57] ABSTRACT

The operating program of a microcomputer is adapted such that once the operator initially selects a submode, the timepiece is disposed into the first operating state of that selected submode, and actuation of any actuator other than that actuator which cycles the timepiece through its plurality of modes, will dispose the timepiece only into other operating states of the chosen submode. The selected submode's operating states are completely independent of other submode operating states and thus the operator cannot dispose the timepiece into the operating states of another submode from any of the operating states of the initially selected submode. In fact the operator cannot exit the initially selected submode unless he actuates the actuator which cycles the timepiece through its plurality of modes, which will dispose the timepiece completely out of the chronograph/countdown timer mode into its next mode.

5 Claims, 2 Drawing Sheets

MULTIMODE ELECTRONIC TIMEPIECE HAVING A MUTUALLY EXCLUSIVE SUBMODE DISPLAY

BACKGROUND OF THE INVENTION

This invention relates generally to multimode electronic timepieces. More particularly, the invention relates to an improved program adapted to display a mode which comprises a plurality of submodes of the timepiece, such as chronograph and countdown timer.

Multimode, multifunction wristwatches (or wrist instruments) are known which include a display, a lamp for illuminating the display, a number of manually actuated switches and an integrated circuit programmed in a preselected sequence. Examples of such watches are seen in U.S. Pat. No. 4,783,733-Houlihan et al., U.S. Pat. No. 4,780,864-Houlihan and U.S. Pat. No. 4,283,784-Horan, all of the foregoing being assigned to the present assignee. In the Horan patent, a timepiece is provided with an integrated circuit, including a main random access memory (main RAM), a flag random access memory (flag RAM) and a programmed logic array (PLA), which are efficiently disposed in the timepiece such that a minimum amount of semiconductor chip space is used. The combination of these elements is adapted so as to provide for greater flexibility for operator selection of one of the plurality of timekeeping functions, or modes. In the foregoing Houlihan patents, which are merely exemplary of multimode electronic wrist instruments or multifunction wristwatches, one of the manual actuators may typically serve to repetitively cycle the instrument through a number of modes and operating states in each of which a different type of information is displayed. Such modes may include, in a multifunction watch, the time of day, chronograph, dual time zone, countdown timer and so forth. By special preselected actuation of one of the actuators, the wristwatch may be converted into a computer, a speedometer, pulsometer or any other type of device, subject only to the imagination of the designer and programmer of the integrated circuit. While in any of these modes, another manual actuator may be employed to change the information being displayed in that mode's state, such as initiating the chronograph timing or setting the time-of-day, or performing a calculation.

Timepieces are known wherein actuation of different preselected actuators will cause the timepiece to be disposed into distinct and separate modes, and which are adapted to perform distinct and separate functions. Such examples include U.S. Pat. No. 4,887,249, Thinesen, Bicycle Watch—Dual Mode Circuit (Dec. 12, 1989) and U.S. Pat. No. 5,050,141, Thinesen, Program to Synchronize Pace in a Multimode Alarm Timepiece (Sep. 17, 1991), both of which are assigned to the present assignee. The former discloses a dual-mode digital wristwatch which is adapted to operate in a "watch mode," displaying such information as time-of-day and date, but can also be adapted to operate in a "bike mode," serving as a computer to display such information as speed, distance andpedaling cadence. The latter discloses a program to synchronize and display the pace of an operator, and includes other modes such as time-of-day mode and chronograph/countdown timer mode, wherein each mode is adapted to display various operating states through the manual actuation of a plurality of actuators.

Although it is possible to provide a multimode electronic timepiece with sufficient memory so that calculations necessary for each of a timepiece's timing subroutines may be performed simultaneously and continuously, it is often desirable to provide the timepiece with less memory in order to reduce the cost of the timepiece and to concomitantly conserve timepiece physical space which is limited. One way to achieve this result is to provide the timepiece with a microcomputer which is adapted to provide some of the timepiece's timing subroutines using the same random access memory (RAM) space such that these timing subroutines can only be operated in a mutually exclusive manner. That is, after the operator selects one of the timing subroutines, such as chronograph or countdown timer, certain memory storage locations of the RAM become solely dedicated to storing those values determined by calculations specific to the chosen timing subroutine. None of these same memory storage locations of the RAM storage is then dedicated to the storage of values of any of the other timing subroutines, and these other subroutines are therefore inactive; i.e., there is no continuous and systematic update of the values of a timing subroutine which has not been selected by the operator.

A problem with such timepieces is that after the operator selects one of these mutually exclusive timing subroutines, thus entering one of its operating states, he is not precluded from selecting an operating state of any other of the mutually exclusive timing subroutines. Confusion of the operator will result, if he accidentally actuates an actuator that is dedicated to one of the mutually exclusive timing subroutines which is currently inactive, because as the calculations necessary to the inactive subroutine are not being continuously and systematically updated, the value displayed will not represent the true and correct value of the operating state of that inactive timing subroutine. Thus it is also desirable to provide a timepiece with mutually exclusive timing subroutines wherein selection of one timing subroutine will preclude the selection of any other timing subroutine while in any operating state of the chosen timing subroutine.

Accordingly, one object of the present invention is to provide a multimode electronic timepiece with reduced random access memory means for storing values for mutually exclusive timing subroutines (or mutually exclusive submodes)

Another object of the present invention is to provide an improved program which is adapted to provide a mode which comprises a plurality of submodes of the timepiece where selection of one of the submodes will preclude the selection of the other submodes while the timepiece is disposed in any of the operating states of the chosen submode.

Still another object of the present invention is to provide an improved program which precludes the operator from determining the status of any of the operating states of a submode other than that of the currently selected submode.

Yet another object of the present invention is to provide an improved program which is adapted to provide the timepiece display with a mode having a display of the mutually exclusive submodes.

SUMMARY OF THE INVENTION

Briefly stated, the invention comprises an improvement in a multimode electronic timepiece having a display, a plurality of manually actuated actuators, and an integrated circuit programmed to keep time and to provide a plurality of modes, said integrated circuit being programmed to permit an operator to sequentially cycle said timepiece through said plurality of modes by selectively and repetitively actuating a first of said plurality of said actuators, wherein said improvement comprises:

mode selection means including a program for said integrated circuit adapted to provide a first mode of said plurality of modes, said first mode having a plurality of mutually exclusive submodes, and said program being further adapted to provide for the selection by said operator of one of said mutually exclusive submodes;

submode selection means including a subroutine of said program adapted to selectively dispose said timepiece into a first submode or a second submode of said mutually exclusive submodes after selective actuation of a second or third of said plurality of actuators, respectively, each of said first and second mutually exclusive submodes having a plurality of operating states wherein repeated actuation of an actuator other than said first actuator cycles said timepiece through the plurality of operating states of said first and second mutually exclusive submodes, respectively; and memory means including random access memory means storage locations for storing values determined for said mutually exclusive submodes by said subroutine of said submode selection means, said random access memory storage locations storing values for a selected one of said plurality of mutually exclusive submodes only when said timepiece is disposed in said selected mutually exclusive submode.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accomapnying drawings, in which:

DESCRIPTION OF THE PREFERRED EMBODIMENT

Figure 1:
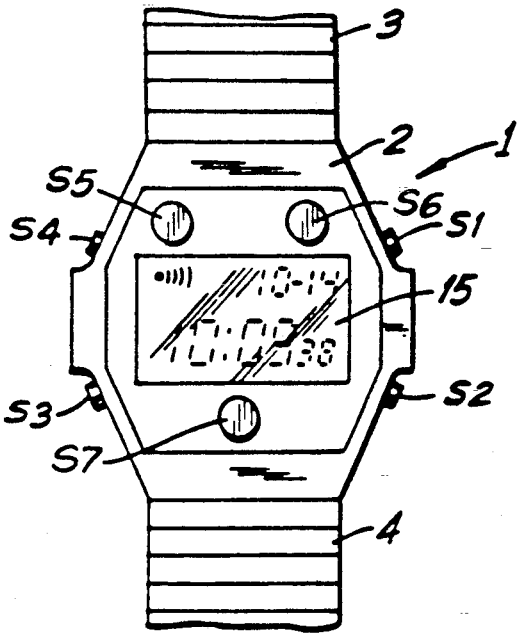
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 7 manual push button actuators S1, S2, S3, S4, S5, S6, S7 arranged to close spring contacts (not shown), inside the watch case 2. An electrooptic display 15, which is commonly a liquid crystal display (or LCD) displays digits, letters or other symbols when activated by a microcomputer inside the watch in the form of an integrated circuit.

Figure 2:
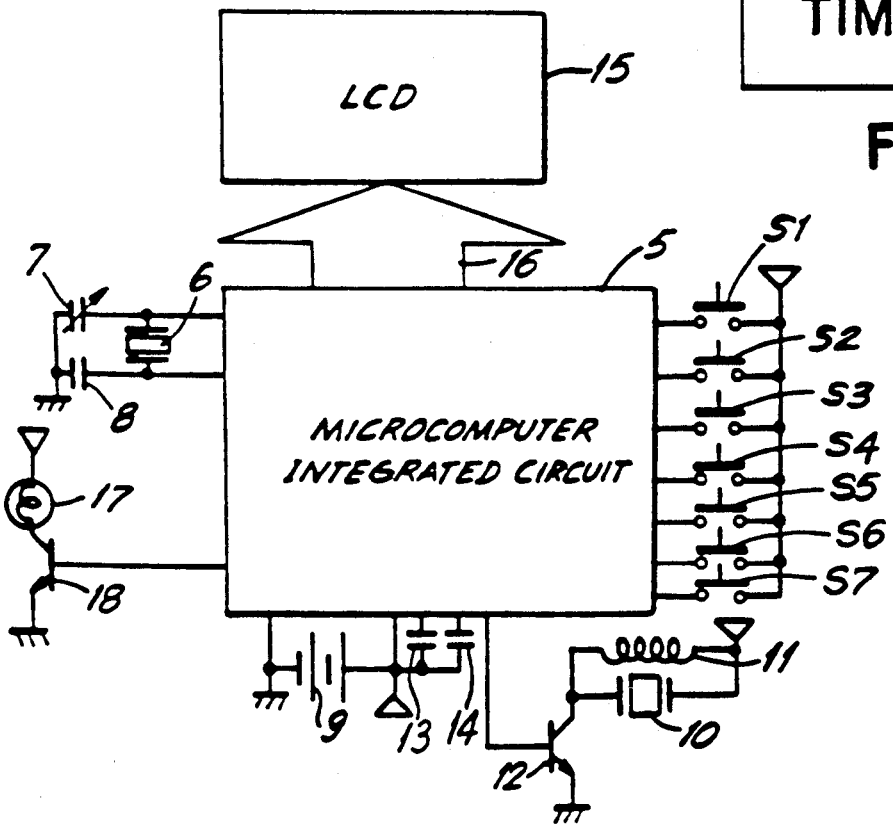
FIG. 2 is a block diagram of a circuit for the wristwatch of FIG. 1, together with external components such as lamp, switches and display.

Referring now to FIG. 2 of the drawing, a schematic block diagram of the electrical connection is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor, operating system program for carrying out instructions, program for providing the timepiece with a plurality of modes, submodes and operating states, and memory locations. (The term "submode" as used herein designates one of the plurality of timing subroutines which comprise one of the timepiece's basic operating modes. The term "operating state" as used herein designates the various functions that the timepiece's operating program is adapted to perform while disposed in a particular submode and any coincidental display of that function's value on the timepiece's electrooptic display 15.) A quartz crystal 6 connected in circuit with capacitors 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors, 13,14 combined with other circuit elements combined inside the integrated circuit 5 serve to boost the output voltage to drive the LCD 15 through a display bus 16, which represents the several parallel leads connected to the various actuatable segments of the LCD display 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
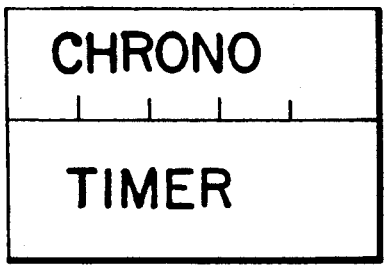
FIG. 3 is a block diagram of the mode that displays a choice of a chronograph and countdown timer submodes.

Reference to FIG. 3 shows a schematic of the mode which comprises the menu of selectable submodes as it is shown on electrooptical display 15.

Figure 4:
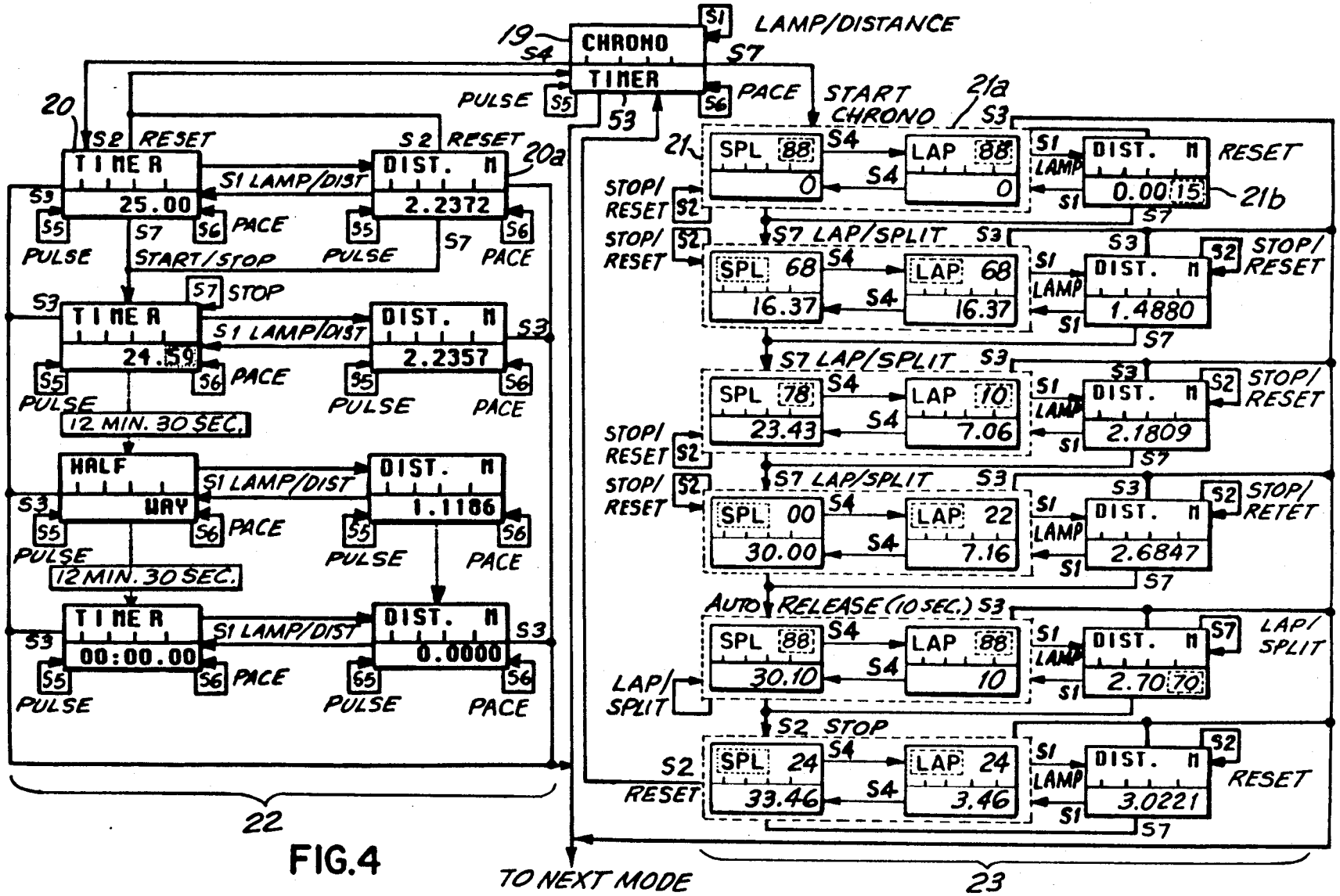
FIG. 4 is a detailed state diagram illustrating the sequence of the operating states of the countdown timer and chronograph submodes in accordance with the present improvement of the present invention.

Referring now to FIG. 4 of the drawing, a state diagram is shown in schematic form, for countdown timer submode 22 and chronograph submode 23. The first rectangle 19 represents the "home" operating state displayed on the electrooptical display 15 when the timepiece is initially placed in the mode as shown in FIG. 3. The lower rectangles represent a state in which change of displayed information may be controlled by the operator. The dotted rectangle surrounding the numeral eighty-eight indicates a continually running display. The instrument continues to keep time and to operate under control of the particular subroutine of the program in the microcomputer chip until the instrument is placed into another state. Manipulation of the electronic wristwatch to illuminate the display and carry out the various functions and capabilities is by selective actuation of the manually actuated actuators S1-S7. The well-known programming technique for determining whether the switches are opened or closed and for taking appropriate action is through the operating system computer program stored in the microcomputer memory, in which each switch condition is tested during each complete interrogation cycle in a loop. If any switch is closed, the program branches to a subroutine which initiates a counter. The counter determines how long the switch has been closed or, if the watch has entered another state how long it has been in that state.

Reference to FIG. 4 illustrates the detailed state diagram for the countdown timer submode 22. Upon actuation of actuator S4 the timepiece is disposed into a first operating state of countdown timer submode 22, and the countdown timer subroutine is initiated. Manual actuation of S7 a first time will stop the "countdown" sequence. Subsequent repeated actuations of S7 will alternately start and stop the sequence. When the timer is stopped during the "countdown" sequence, the operator may actuate actuator S2 one time to display the last set time operating state, or two times to display the chronograph/countdown timer mode 19.

At any time when the instrument is displaying the elapsed time operating state 20 of the countdown timer submode 22, the operator may instead display the distance to be traveled operating state 20*a*, by manually actuating S1 which will also illuminate the lamp. A second actuation of S1 will return the instrument to the elapsed time operating state 20. Subsequent repeated actuation of S1 will cause the instrument to alternately display the elapsed time and distance to be travelled operating states 20 and 20*a*.

Reference to FIG. 4 illustrates the detailed state diagram for the chronograph submode 23. The integrated circuit is programmed to place the timepiece into the first operating state 21 of the chronograph submode 23 upon actuation of a manual actuator S7 while the timepiece is disposed in the chronograph/countdown timer mode 19. This single actuation of actuator S7 will initiate the chronograph subroutine, causing the display to increment every hundreth of a second. Repetitive actuation of S7 will display the elapsed time since the last closure of S7, either in split time (cumulative time elapsed since first switch closure) in which case the timepiece display will show "SPL" 21, or in lap time (time elapsed since previous switch closure) in which case the timepiece display will show "LAP" 21*a*.

A single actuation of S2 while the chronograph is incrementing but before actuation of S7 will stop the chronograph subroutine, and a second actuation of S2 will reset the timepiece and dispose the timepiece into the chronograph/countdown timer mode 19. If however, the operator actuates S2 after actuation of S7 (i.e., S2 is actuated while "LAP" or "SPL" is being displayed), the chronograph will also stop, but a second closure of S2 at this point will cause the display to show the elapsed time between the current and previous closures of S2. A third actuation of S2 will then reset the timepiece to the chronograph/countdown timer mode 19.

Repetitive actuation of actuator S4 will cause the timepiece to be alternately disposed in split mode 21, and lap mode 21*a*. A single actuation of actuator S1 from either split time or lap time will concurrently illuminate the timepiece's lamp (not shown) and dispose the timepiece into the distance operating state 21*b* of the chronograph submode 23. A second actuation of S1 will dispose the timepiece back into either lap time 21 or split time 21. The integrated circuit is also adapted to provide for an automatic return to the chronograph-/countdown timer mode 19 after the elapse of ten seconds.

Ordinarily, program instructions and data, in the form of bytes and words, are assigned a unique address in a timepiece memory. In accordance with the present improvement, however, the timepiece memory includes random access memory means (not shown) which are adapted to store, in the same memory address locations, values determined for each one of a plurality of certain predefined submodes, but store the values for one of these predefined submodes only when it is selected for operation by the timepiece operator, the timepiece being thus disposed in that predefined submode.

Thus, for example, when the timepiece operator selects the countdown timer submode, certain predefined memory address locations of the RAM means will be dedicated to storing only those values determined for the countdown timer submode. When, however, the countdown timer submode is not selected for operation, the predefined memory address locations initially associated with the storing of values for the countdown timer submode will, in accordance with the present improvement, be available for the storing of values of another of the predefined submodes. Thus if the timepiece operator choses the chronograph submode, these same memory address locations will instead store the values determined for the chronograph submode.

Therefore, in accordance with the present improvement, no memory address locations are dedicated to storing values of a predefined submode when it is not selected for operation by the timepiece operator, and thus an unselected submode of these predefined submodes is inactive; i.e., there is no continuous and systematic update of the values of a predefined submode that has not been selected by the timepiece operator. Thus the operation of these predefined submodes is mutually exclusive; that is, operation of one of these predefined submodes precludes the operation of another. (Hereinafter, these predefined submodes are referred to as mutually exclusive submodes.)

However, it is also then necessary to preclude the timepiece operator from selecting a different mutually exclusive submode whose values are not being continuously and systematically updated, in order to avoid operator confusion. Thus also in accordance with the present invention, the operating program of the microcomputer is further adapted such that once the operator initially selects a submode, the timepiece is disposed into the first operating state of that selected submode, and actuation of any actuator other than that actuator which cycles the timepiece through its plurality of modes, S3, will dispose the timepiece only into other operating states of the chosen submode. The selected submode's operating states are completely independent of other submode operating states and thus the operator cannot dispose the timepiece into the operating states of another submode from any of the operating states of the initially selected submode. In fact the operator cannot exit the initially selected submode unless he actuates S3, which will dispose the timepiece completely out of the chronograph/countdown timer mode 19 into its next mode (FIG. 4).

Again referring to FIG. 4, once the operator actuates either S4 or S7, the timepiece will be disposed into the first operating state of the countdown timer submode 22 or the chronograph submode 23, respectively. Subsequent actuation of any of the plurality of actuators other than S3, including S4 and S7, will dispose the timepiece into the various other operating states of the selected submode. The operator can neither purposefully nor accidentally select any of the operating states of the non-selected submode. And, in fact, only upon actuation of S3 may the operator exit the initially chosen submode; and this actuation will place the timepiece into the next mode of operation. Accordingly, the operator cannot accidentally select an alternate submode operating state, and there is little chance for operator error.

A very simple two submode timepiece has been described in order to illustrate the principle of the invention. However, the invention is applicable to timepieces having a mode or plurality of modes which comprise more than two submodes or timing subroutines.

The term "mode" is used herein to designate the basic operating modes of a multimode electronic timepiece.

The term "submode" is used herein to designate one of the plurality of timing subroutines which comprise one of the basic operating modes.

The term "operating state" is used herein to designate the various functions that the timepiece's operating program is adapted to perform while disposed in a particular submode and any coincidental display of that function's value on the timepiece's electrooptic display 15.

While there has been described what is considered to be the preferred embodiment of the invention, other modifications will become known to those skilled in the art, and it is desired to cover, in the appended claims, all such modifications as fall within the true spirit of the scope of the invention.

What is claimed is:

1. Improvement in a multimode electronic timepiece having a display, a plurality of manually actuated actuators and an integrated circuit programmed to keep time and to provide a plurality of modes, said integrated circuit being programmed to permit an operator to sequentially cycle said timepiece through said plurality of modes by selectively and repetitively actuating a first of said plurality of said actuators, wherein said improvement comprises:

mode selection means including a program for said integrated circuit adapted to provide a first mode of said plurality of modes, said first mode having a plurality of mutually exclusive submodes, and said program being further adapted to provide for the selection by said operator of one of said mutually exclusive submodes;

submode selection means including a subroutine of said program adapted to selectively dispose said timepiece into a first submode or a second submode of said mutually exclusive submodes after selective actuation of a second or third of said plurality of actuators, respectively, each of said first and second submodes having a plurality of operating states wherein repeated actuation of an actuator other than said first actuator cycles said timepiece through the plurality of operating states of said first and second mutually exclusive submodes, respectively; and memory means including random access memory means storage locations for storing values determined for said mutually exclusive submodes by said subroutine of said submode selection means, said random access memory storage locations storing values for a selected one of said plurality of mutually exclusive submodes only when said timepiece is disposed in said selected mutually exclusive submode.

2. The improvement according to claim 1, wherein said display of the timepiece is adapted to display the selection of submodes.

3. The improvement according to claim 1, wherein said plurality of submodes consists of a chronograph submode and countdown timer submode.

4. The improvement according to claim 3, wherein said chronograph submode includes operating states selected from the group comprising: split time, lap time, and distance covered.

5. The improvement according to claim 3, wherein said countdown timer submode includes operating states selected from the group comprising: time elapsed and distance.

* * * * *